US005386397A

United States Patent [19]

Urroz

[11] Patent Number: 5,386,397

[45] Date of Patent: Jan. 31, 1995

[54] METHOD AND APPARATUS FOR KEEPING A BODY SURFACE, WHICH IS IN CONTACT WITH WATER, FREE OF FOULING

[76] Inventor: Augusto C. R. Urroz, 6990 Montegrande St. 7600 Mar del Plata, Province of Buenos Aires, Argentina

[21] Appl. No.: 158,498

[22] Filed: Nov. 29, 1993

[51] Int. Cl.[6] ..... H04B 1/02

[52] U.S. Cl. ..... 367/139

[58] Field of Search ..... 367/139; 114/222, 67 R; 244/204

[56] References Cited

U.S. PATENT DOCUMENTS

| | | | |
|---|---|---|---|
| 4,170,185 | 10/1979 | Murphy et al. | 114/222 |
| 4,516,747 | 5/1985 | Lurz | 244/204 |
| 4,943,954 | 7/1990 | Ostlie | 367/139 |

*Primary Examiner*—Daniel T. Pihulic

[57] ABSTRACT

A method and sound wave generating assembly for keeping a surface free of scale, fouling and dirty generated by the adherence of in water-living organisms such as marine life, the surface being part of a body that is in contact with water, the method comprising the step of generating and emitting, from at least one location of the body, at least one high-frequency sound wave train, forming, adjacent the body surface, a vibrating field encircling the body surface, wherein the molecular kinetic energy of the water within the field is increased to generate a drastic drop in the density of the water as well as in the density of the cells of the organisms entering the vibrating field, thus alterating the habitat of the organisms and discouraging the organisms from adhering to the body surface.

19 Claims, 1 Drawing Sheet

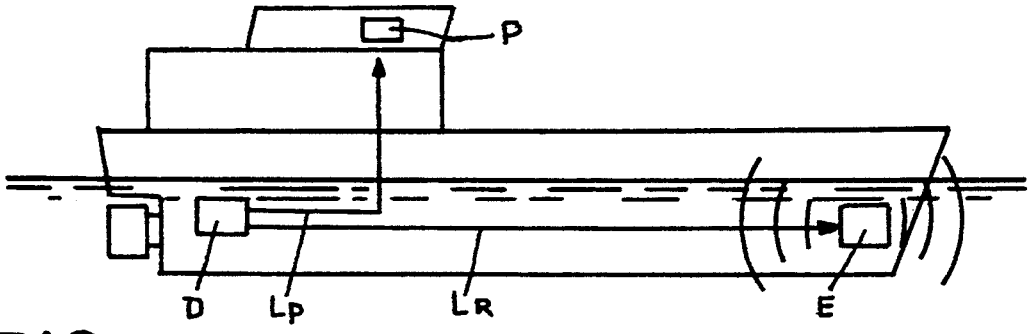
FIG.1
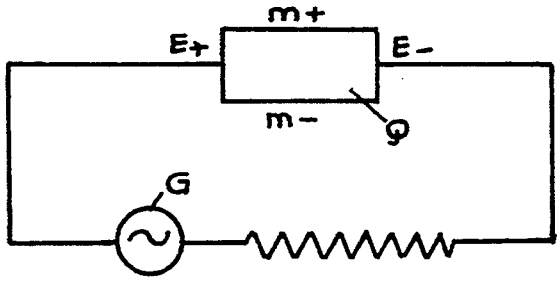
FIG.2
FIG.4
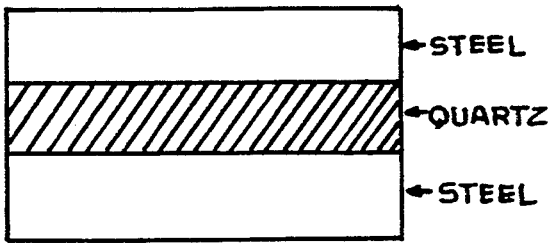
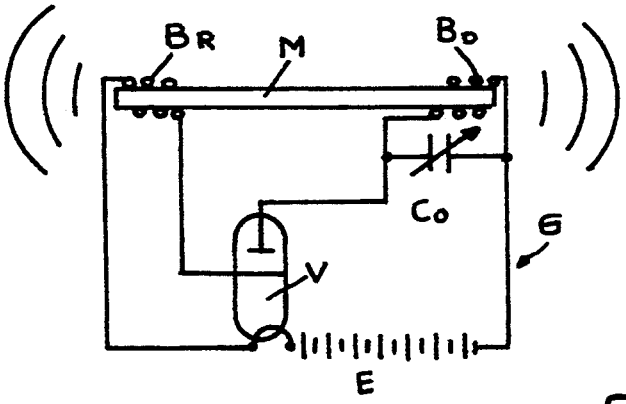
FIG.3
FIG.5
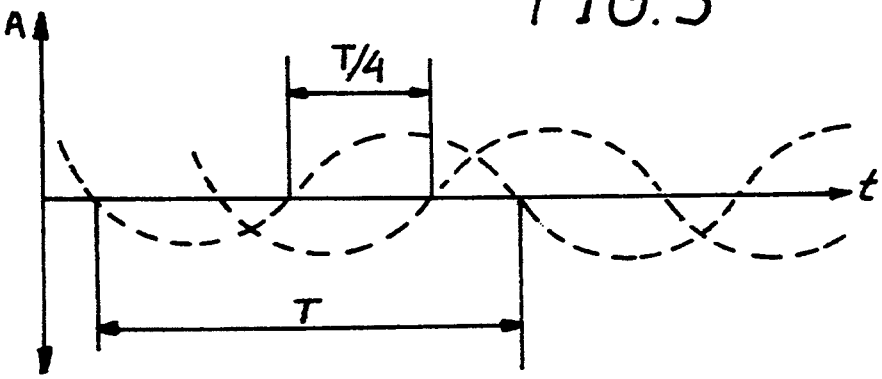

METHOD AND APPARATUS FOR KEEPING A BODY SURFACE, WHICH IS IN CONTACT WITH WATER, FREE OF FOULING

BACKGROUND OF THE INVENTION

1. Field of the Invention

The present invention relates to a method for keeping a body surface free of scale, fouling and any other kind of dirty generated by the adherence of in-water living organisms, such as marine life, such surface being in contact with water. The invention also relates to a sound wave generating assembly for the same purposes of the above referred method. Although the present method and assembly are preferably applied to hulls of vessels and boats, and although this specification relates to such vessels and boats, those references are just given as examples while the invention may be applied to any body in contact with water, such as floating supports for bridges, sheet protective barriers, marine oil platforms, marine oil pipes, general piping and all bodies that are temporarily or permanently in contact with water.

The problem which affects the hull of a vessel and particularly the bottom thereof, that is the portion of the hull under water surface, involves enormous economic and financial looses to the naval industry, naval trade companies and insurance companies. A basic problem is that the surveys along the life of the vessel are directly related to the conditions of operation of the hull, thus when the hull is so damaged to an extent that its structural features are generally deteriorated, the hull, economically speaking, is impossible to be repaired whereby the vessel is out of service and scrapped or wasted.

The hull is damaged by different agents, such as physical agents, chemical agents and biological agents. The physical agents are elements that impinges on the hull or bottom thereof and generate a direct damage. Thus the protective layer or covers the hull such as paints are removed and the material of the hull, i.e. steel, is exposed to be in direct contact with water. If the water is salt water the steel is energically attacked. The chemical agents particularly act in such places where the physical agents have removed or damaged the protective covers. Although in the remaining parts of the hull the chemical agents also act, they take more time to reach to the steel after the protective covers have been damaged. In such places the hull becomes rusty and the steel plates thereof must be replaced. Finally, the biological agents, microscopic or macroscopic, generate scale, fouling and barnacles adhered to the hull, chemically and mechanically affecting the hull, which effects are the most important generated by living agents having a large biological activity. From the mechanical point of view, the weight of the vessel is increased by enormous quantity of this kind or organisms and, in addition, the navigability conditions are directly affected because of the increasing of the frictional resistance generated by the irregular surface of the fouling, directly leading to the lost of speed of the vessel.

While the physical processes are contingent, like a collision, and the chemical processes act in particular conditions such as aging of the protective covers or after the first action of the physical agents, the biological agents start to act immediately after the vessel is launched and act steadily and continuously. Additionally, the action of the biological agents leads to and accelerates the above referred chemical process because they generate micro fissures of clefts in the paint layers, thus allowing the sea water to enter in contact with the hull steel and chemically acting on it generating oxidation that damages the steel. Thus, the biological processes are very important. In order to set an example of the steps of the oxidity process on the hull and its relationship with the biological agents, it may be useful to see that the iron oxidation (rust) involves the following four steps:

(1) $Fe_{(s)}$ - - - $Fe^{+2}+2e^{-}$ (2) $e^{-}+H$ - - - $H$

H being provided by the water or acids of the organisms adhering mechanisms.

(3) $4H+O_{2(g)}$ - - - $2H_2O$ (4) $4Fe^{2+}+O_{2(g)}+(4.2\%)H_2O$ - - - $2(Fe_2O_3 \cdot xH_2O)_{(s)}+8H_+$ wherein $2(Fe_2O_3 \cdot xH_2O)_{(s)}$ is rust and $8H_+$ accelerates the reaction of formulae (2).

The net reaction, considering the four steps, is:

$$4Fe_{(s)}+3O_{2(g)}+2xH_2O \text{ - - - } 2(Fe_2O_3 \cdot xH_2O)_{(s)}$$

The existence of biological acids, either produced by some of the adhering mechanisms of the agents or existing as natural elements of the metabolism of the agents, accelerates the second step of the oxidation equation by capturing the electrones released by the mutual iron on its hydrogen cations (H). The altered or broken paint layer that allowed the beginning of the reaction, plus the layer of rust that accelerates the second step of the above formulae when producing hydrogen cations, plus the scale layer plus the fact that all is in an aerobic medium, should operate as a barrier to the gaseous oxigen necessary for the third step of the above equation and therefore the process should be stopped. However the process does not stop because the metabolism of the algae, either unicellular or pluricellular organisms, (due to the biochemical process of photosynthesis) forms and releases gaseous oxigen in the medium, which accelerates the first step of the equation increasing thus the oxidative process.

Considering the damages that the three above mentioned agents make in the vessels, all the countries as well as naval insurances and registers have established that a vessel must be registered, periodically revised, controlled and cleaned in order that the hull be in operative conditions.

To take an idea of the financial and economical consequences of the lost of speed and the need of periodical cleanings of the hulls, it may be interesting to see that in 1980 the mercantile marine of the world consisted of 420 millions of tons and the navy had 150 millions of tons, 175 millions of tons corresponding to oil transporting ships.

The above figures remark the great importance of the damages caused by the above cited agents in the vessel hull and they give an idea of the enormous quantity of square meters of hulls which should be cleaned annually.

With reference to marine oil platforms and to give an idea of the importance of the above phenomenom, it may be said that in the North Sea there are more than 150 platforms and more than 6,000 kilometers of piping, the cleaning and maintenance thereof involving very high costs.

Prior to enter into the concept of the present invention, the applicant feels necessary to first describe the complex interaction existing between the biological agents, the special characteristics of the medium wherein these agents live, its differences with other known medium, and a syntactic classification of the several groups of agents which accelerate the damaging of a ship and other bodies (metallic or not) in contact with water.

The big difference between the sea environment and the ground or soil environment is that in the sea the scientific variables thereof are restricted to short ranges, while the living ranges for conditions in the ground are wider. The sea environment is more stable because its thermal variations are lower and its changes are slow due to the regulating features of the water; the salt concentration is constant, only varying the kind of ions (3.5% of concentration except the Dead Sea with a concentration of about 25%); the aqueous medium has the same osmotic pressure that the protoplasm of the organisms cells; this is why the membranes of these organisms do not suffer the pressures to which the organisms living on the ground are subject (mechanical action); the water density is uniform and not variable while the marine life is not adapted to changes. These and other reasons make the marine environment a very stable environment and the life living in this medium is adapted to this stability. Therefore the tolerance limits for life are very restricted and, because life is adapted to such conditions they are extremely sensitive to any change in the environment. An example of this is the sensitivity of the microflora and the macroflora as well as the micro and macrofauna to any contaminant which, although with a lower concentration, leads to the immediate dead thereof.

A biological community live in a limited zone or "habitat" which may be extended or reduced. One of the most important principles of the ecology is that animals and vegetals live all together in armonic arrangement, without being randomly spreaded all over the earth surface. All new zones (i.e. a just launched ship) will receive the establishing of a methodical succession of communities, with change their state and leas to a mature and stable community, namely a top community. The series are so regular that an ecologist, when studying the community may foresee the succession of future changes.

The ocean is a big reserve of nutritive elements which are essential for the beings living therein as well as in the ground. It is evident that the total weight of the organisms living in the ocean (biomasa) exceeds the weight of all the beings living on the ground and sweet waters.

Because of the seas are communicated to each other, the sea life has no limits but just limited by factors like temperature, salinity (kind of ions) and depths.

The sea may be divided into regions characterized by different physical conditions and, therefore, regions inhabited by specific classes of animals and vegetals; thus there is a "continental bank" extended along a uniform distance from the seashore and the depth thereof slowly and gradually increases, then, there is a continental "barrier" and finally there is the "abyssal depth". The region of shallow waters in the continental bank is called "neritic zone". The high sea that is out of the continental bank is the oceanic zone. The superficial portion of water wherein the sunligth penetrates to allow photosynthesis in the life development is called "eufotic zone", the lower limit thereof varying between hundred to two hundred meters depending on the water clarity. The region under the sufotic zone is called "batipelagic", extended up to a depth of two thousand meters while under this zone the region is called abism, the depth thereof exceeding ten thousand meters.

The neritic zone may be divided into the high tide zone, the intermediate zone and the low tide zone. The tide zone, one of the most favourable habitats, it is supposed to be the base where the life started. Water, ligth, oxigen, carbondioxide and mineral salts are extremely convenient for the vegetal life. Full of vegetal life, this zone is a good shelter and a provision of food for any animal species. Immediately after a solid body appears in the environment, a large variety of algae can fix themselves onto the body, as well as mose, sea coralina, etc., forming a community. This is a fundamental characteristic of this medium. There exists a rivalry between the vegetals for reaching to occupy enough space and between the animals for food. The limit for the development of the species is the limited space wherein the growth may be fixed and settled. All the biological potential of the sufotic zone in the high sea remains intact because of the lack of points wherein the organisms can fix, however the macroflora can not develope.

Within the microscopic world there are protozoans like phoraminipherals and radiolareans, little crustaceous and larvas for many species.

No reference to superior animals will be made because of the lack of importance thereof in connection with the present invention. Sweet water such as lakes and moving waters such as rivers have biological communities which are more know than the sea communities and generally, although they are different communities they have common phylum and the ecological behavior thereof is similar, particularly to connection with the colonization mechanisms or the capacity of adapting to a body or area in the environmental equilibrium. In order to understand the diversity and complexity of the biological agents a synthetic classification will be given, particularly referring to certain phylum of big importance because of the number of members and generic existence in all the seas:

| | | |
|---|---|---|
| PROTISTAS | Some Flagellata | |
| | Mosses | |
| VEGETAL KINGDOM | Bacterium | |
| | Algae | Blue-green (2500 sps) |
| | | Green (5000 sps) |
| | | Brown-golden phylum: crysophyta (diatom) |
| | | phylum: pirrophyta (diniflagellata) |
| | | Brown (1000 sps) phylum: phaeophyta |
| | | Red phylum: rhodophyta |

VEGETAL KINGDOM

Bacterium

They live in all environments including oceans and even in the glacial ice.

Algae

They are primitive plants classified in the sub-kingdom of thallofits, encircling more than hundred thousand species broadly spreaded all over the seas, rivers, ground and even parasitic plants and animals. The sizes vary from microscopic unicellular plants up to giant sea algae that may reach the hundred meters. The algae have photosynthetic activity. They are fundamental for the sea life because they are the first link of any traffic chain. Without algae there are no possibilities of development of the sea life.

Most of the phyto planktom comprises cocolitines, diatoms and dinoflagellata.

Blue-Green Algae (phylumcianofita)

These algae are the most primitive plants with clorophyll and they have blue pigment (phycocianine) as well as tarotine and santophill and carbohidrates in the form of "cianoficio" starch. This algae is found not only in the ocean but also in sweet waters and even in thermal water sources. The name of Red Sea is due to the existence some times of the species tricodesmiun having a red pigment that gives its color to the sea. 500,000 members per cubic centimeter have been found in this sea.

Another "cianophysias", more primitive, the chroococales, with the species Chroococus y Gloeocapsa form gelatinous linings on the rocks forming colonies, joined by means of stratified gelatinous cover (colonizer).

Green Algae (phylum chlorophyta)

Comprises five hundred species living either in sweet water or salt water. They have chlorophylia A and B, sunthophyll and carotine. The food is stored in the form of starch and forms a cellular wall. There are unicellular and pluricellular ones (like philaments) and superior forms that have planar formations like leaves. They may fix to any kind of surfaces (submerged up to six meters) and even on ice sometimes forming big layers. Some algae have forms similar to plants, with leaves, roots and stems and they adhere to fix to the surface of submerged bodies by means of roots.

Brown-Golden Algae

For the purpose of the present invention only two phylum are interesting, namely phylum crisophyta formed by many groups and one of these is the diatoms, which are microscopic vegetals, generally unicellulars living in sweet water as well as in salt water and which are an important food source for animals. They have cellular walls comprising sillicium in a "petri-like" shape (that is two circular boxes one within the other). They are so little that they are in the limit of size that can be seen at the microscope. The food is in the form of oil like in primitive diatoms. The remaining of the cellular walls of sillicium-basis form deposits or sediments on the submerged bodies in the sea bottom. There are primitive deposits of diatoms, for example, in California, wherein they have a thickness exceeding the three hundred meters. In many species there are musilaginous pores through which a gelatinous substance flows, which participates in the joint of the fixed forms and in the formation of colonies (mechanism used for fixing onto a vessel hull). Diatoms have a brown pigment called fucusxantine, which is of great importance for the life in the earth, together with a dinoflagellata, producing a seven percent of all the synthetized organic substance of the earth planet.

The other phylum is the birophitas or dinoflagellants which are unicellular algae with an imbricated shell and being movil thank to two flagellum; this phylum has fucoxantine and clorophyll. Most of the species live in the sea and they are very important for the photosynthesis in the sea. Big quantities of these algae give the sea a red color and they are toxic for the vertebrata if eaten in important quantity, leading to the death of fish but not of bivalves (mussels), neither of mollusks (octopus, calamary). However, in the case the man eats these bivalves or mollusks, toxicity may lead to death.

Brown Algae (phylumphaeophita)

They comprise approximately one thousand cellular species of algae, the size of which reach to one hundred meters length. These are brown-greenish algae that cover the sea bottom up to fifteen meters of depth. They have high concentration of brown-golden pigment (fucoxantine) covering the clorophyll. The colors vary from brown to gold or black. They seem like superior vegetals with a complex structure, with leaves, stems and roots. They live in all the seasides, the most of them being found in cold waters. They are the biggest and most resistent ones and can firmly fix to the rocks or to any submerged solid body by means of their rhizoids. These algae are the food and the shelter for an enormous quantity of sea life.

Red Algae (phylum rhodophyta)

Like the phaeophytas they are almost exclusively in the sea. They are thiner and lower than the brown algae. Their characteristic is the red pigment, the "phicoeritrine", in addition to the clorophyll because of which they have different color tones from rose to purple. They may be found from the sea surface up to hundred meters of depth (this is to exclusively take advantage of the blue and violet have lengths to synthetize organic substances). Approximately three thousand pieces of rhodaphyceaes are known. They have toothed bodies although they can not resist the movement of the water and, because they are not so strength they are usually found in quiet waters. Some red algae, namely "coralines" take calcium from the sea water and deposit it in their bodies; these algae may abundantly be found in the tropic waters and they are more important than the coraline animals in the formation of "coral atolls".

INFERIOR INVERTEBRATA

Phylumprotozoa

The marine protozoan do not have contractile vacoule and therefore the concentration of the sea water salt is similar to the concentration of their protoplasm. The ocean has millions of amoeboid protozoans namely foraminifers which segregate multiple calcareous shells; once dead, these protozon form a gray and that, step by step, is transformed in line (The Dover white scarps in England are deposits of silica which form rocks like flints).

Coelenterata

They have the capacity of producing nematosys or systems that eliminates chemical substances which are urticating for the life (poison). Most of them live adhered to submerged bodies, in some cases passing all the life on these bodies and in other cases having alternating cycles. The phylum coelenterata comprise, among apparently different forms like medusa, coral (polyps), sea anemona, 4,500 different species. Some of these species like the polyps, form colonies of thousands of specimens, which start from one specimen which, by means of gemmation, originate other ones and these others originate additional ones. In shallow waters and warm waters, practically all the bottom and free places are covered by coral and anemona. For example, the known reeves and atolls of southern seas are formed by millions of bodies of dead microscopic cap-shaped animals, segregated in old geological ages by colonies of corals or coral-bearing plants wherein only the outermost located plants live, while the segregation thereof is added to the underlying already dead organisms.

SUPERIOR INVERTEBRATA

Phylum Annelida

Comprise 8,000 species divided in four classes:

Polychaeta: Comprise marine worms that move freely in the water and are capable of hiding under the sand and living in a tube formed by the calcareous secretion of their bodies.

Glygochaeta: Have a few of chaetas.

Archiannelida: Consist of a few small marine worms without segmentation and without chaetas or briskles.

Hyrudinca: comprise leeches.

Plylum arthropoda: The marine classes of this phylum are:

Tribolita: extinct since 250 millions of years ago.

Crustacea: include shrims, crabs, water phleas, etc., mostly acuatic.

Phylum mollusk:

Comprise 80,000 species and is the second level of the animal kingdom. Comprise mussels, snales, octopuses, etc and the giant calamary (the biggest one of the invertebrata). The most primitive mollusk is similar to marine annelide. Some species set algae taken from the bottom rocks. The bivalves, such as clams and some mussels, make excavations in the sand or mud by means of a foot, while the other kind of mullusk has a capacity of drilling rocks or wood to hide, i.e. craft worms also called "traza" or "teredo" which damages the piles of docks or wharfs.

As stated above, the maximun limit for the increasing of a sea biomasa are physical spaces on which to adhere and for which the sea life is in competition in the neritic and eufotic zone. Therefore, the marine growth or sea life finds an ideal environment for colonization and development in vessel hulls, thus making the hull to become an artificial reef in harmony and equilibrium with the environment of which the hull is forming part. Therefore, the vessel hull in the eufotic zone developes an artificial neritic zone.

When a vessel is launched it artificially and arbitrarily interferes with the medium, that is water, however it is neither entirely adapted nor prepared to remain a long time in that medium complying with its aims. The vessel is just designed and prepared to float, to sail, to resist the wave impacts and to avoid rust as well as the consequences of galvanic currents. However, it is not prepared to avoid the adherence of marine growth, that is it is not prepared to become a reef.

The colonization of a new reef, in this case the hull, is done through the fundamental ways, both independent from the other. One of these ways is the adherence of algae and unicellular microscopic coral, then, over these species other pluricellular ones and microfauna are established which live at the underlying specie's expense; these species having specialized mechanisms to firmly adhere to solid bodies such as a hull; when dead, these species live calcareous structures over which other algae and phylum of marine microfauna are adhered forming thus an optimun environment for developing of life. This structure has a lot of different species and phylum as well as a lot of new species continuously joining the new colony what is optimun for the development of big algae on the surface of the hull.

The other way of colonization is carried out by a kind of mollusk having the capacity of drilling rocks or woods, that is the called vessel worms, which damage the wood of hulls and any other marine installation by drilling holes thereon. This mollusk produces holes in the covers (paints, etc.) of the hull up to reach to the steel, any other metal or wood. In both cases the damages are considerable. In metal hulls, sea water will thus easily generate rust, rapidly damaging the hull. In the case of wood made hulls, the structure of the vessel will seriously be damaged.

2. Description of the Prior Art

Heretofore the most usual solution to the above referred problems has been to annually revise the hull in a dry dock, clean it and repaire it. In other cases, this work is made by divers, particularly when only some locations of the hull should be revised and repaired. In any case, this takes a long time and is costly. This is equivalent to 8.5 to 10% lost of freight per year and this is considered as being an operative cost in the financial analysis.

In this period wherein the ship is out of service the cleaning purposes, the amortization share (or a depreciation of the unit because of the out of service time), as well as the international financial interests (as a minimun the libor rate for the not operative period) must be added to the cost of maintenance. To this cost, the cost of personnel must be added. Thus:

$$C=A+i+G$$

wherein

C=cost;

A=amortization;

i=interest over capital; and

G=expenses (salaries, taxes, maintenance).

As a consequence of the above, the costs of the services for a ship are importantly increased due to the cleaning and maintenance of the hull, and this increasing is important.

Another consequence of having to clean and maintain the hull is that the fouling and adherences are removed by using energic treatments depending of the amount of fouling. These treatments generally cause damages, wearing and erosion and, after some treatments, some steel plates must be replaced because of their resulting small thickness. In addition, the time the hull remains cleaned is reduced progressively, in direct relationship to the several cleaning services. After six months from a cleaning service, a ship looses one knot in speed, for example, taking two more days from Buenos Aires to Europe.

In addition, according to international rules a ship should be removed from water to be serviced annually, for cleaning and controlling purposes. Although the first mandatory period may be extended, no extension is available after the first cleaning service. The cleaning and controlling of a ship are also required by the international insurance companies.

In order to minimize the above problems it has been an attempt to avoid mechanical damages by using, for example, magnesium blocks strategically located on the surface of the hull, as sacrifice blocks, to avoid that galvanic currents damage the hull.

Another method comprises "cataphoresis", consisting of submerging the hull into a bath to avoid hull rusting. Many kinds of paints are also applied to protect the hull.

The only method used to prevent the marine organisms from adhering onto the hull has been chemically oriented and it consists of the use of biocide substances of variable active spectrum. The disadvantage of these products is their residual action, like any other chemical compound, because it is diluent in water and looses thus the necessary concentration to be biocide.

As a consequence of this, not only the aim of these products are not achieved but also the sea is polluted.

The enormous quantity and kinds of growth that live in the water an the hull affecting the latter mechanically and chemically, have made the conventional control techniques like special paints, biocides, poison, etc. to fail.

There are other arrangements that consist of control units that send signals to resonators that are fixed to the hull. Many resonators have to be installed onto the hull and generally each resonator protects the hull in an area of about ten feet of diameter. This, however, does not achieve an uniform distribution of resonating waves along the entire length of the hull as well as many nodal points appear on the hull wherein the resonating waves neutralize to each other without preventing all the organisms from adhering onto the hull.

3. Summary of the Invention

To overcome the above referred drawbacks, the inventor has focused the problem from a different and new point of view and he found a solution that avoids, from the beginning of the biological process, the establishing of these communities onto the hull. Thus, the object of the present invention is to interrupt the colonization mechanisms from the beginning, preventing the adherence of the begginer organisms by means of which the formation of the reef is barred by interrupting the colonization chain. Thus, the adherence of secondary inhabitants (heterotrofos) is prevented.

It is therefore an object of the invention to repel the biological agents and avoid the action thereof on the ship hull. This subject is achived by generating an alteration in the environment close to the outer hull surface, in which altered environment no sea life (generally is beyond the tolerance limit of the involved species. This alteration consist of a drastic decreasing or dropping of density in the water moleculae surrounding the hull and therefore in the cells entering in contact with or in a layer close to the hull surface. An alteration of this magnitude in an aquatic environment prevents the hull from being colonized, because the organisms are tremendously affected and there is no possibility of establishing a community in equilibrium with the medium. This is because the autotrophae (primary organisms), which are unicellulars, can not start the colonization process and therefore, the foraminfer protozoans, like coelenterata (coral), annelida, etc., are not able to fix onto the hull. This environmental alteration is achieved by generating vibrations in the hull, by at least one high-frequency-sound waves train which may be continuous and steady.

It is another object of the present invention to provide A method for keeping a surface free of scale, fouling and any other kind of dirty generated by the adherence of in water-living organisms such as marine life, the surface being at least part of a body that is in contact with water, such as vessels, hulls, general floating members, marine platforms, water delivery piping, marine oil pipes, boilers and the like, the method comprising the step of generating and emitting, from at least one location of the body, at least one high-frequency sound wave train, forming, adjacent the body surface, a vibrating field encircling the body surface, wherein the molecular kinetic energy of the water within the field is so increased as to generate a drastic drop in the density of the surface surrounding water as well as in the density of the cells of the organisms entering the vibrating field, thus alterating the habitat of the organisms and discouraging the organisms from adhering to the body surface.

It is still another object of the invention to provide sound wave generating assembly for keeping a surface free of scale, fouling and any other kind of dirty generated by the adherence of in water-living organisms such as marine life, the surface being at least part of a body that is in contact with water, such as vessels, hulls, general floating members, marine platforms, water delivery piping, marine oil pipes, boilers and the like, comprising at least one wave generating-emitting apparatus for generating and emitting at least one high-frequency sound wave, the apparatus having an outlet connected to a mechanical transducer affixed to a first location of said body, said wave generating-emitting apparatus being connected to a power source.

The above and other objects, features and advantages of this invention will be better understood when taken in connection with the accompanying drawings and description.

BRIEF DESCRIPTION OF THE DRAWINGS

The present invention is illustrated by way of example in the following drawings wherein:

FIG. 1 schematically shows a preferred embodiment of the sound wave generating assembly of the present invention, applied to a conventional vessel;

FIG. 2 shows a generator-transducer apparatus, of the electric kind, for the assembly of FIG. 1;

FIG. 3 shows a generator-transducer apparatus, of the magneto-strictive kind, for the assembly of FIG. 1;

FIG. 4 shows a three layer mechanical transducer for the assembly of FIG. 1, and finally, FIG. 5 is an amplitude-time chart illustrating the time relationship between the wave lengths generated by the apparatus of FIGS. 2, 3 or 4.

DESCRIPTION OF THE PREFERRED EMBODIMENTS

According to the invention, the ultrasonic vibration is produced by an elastic vibration having a frequency of about 30,000 cycles per second, the propagation speed thereof depending on the medium wherein the waves propagate. In an homogeneous solid body, the average propagation rate would be 5,000 meters per second, which value varies depending on the kind of material, for example, the waves propagate more rapidly in mtal than in wood. Therefore, it would be necessary to regulate the ultrasonic emission depending on the kind of material of the hull, thickness and homogeneity thereof.

With the purpose of repelling the micro and macroorganisms it is not necessary to employ a frequence that kills the cells (biopsy effect of the ultrasonic vibrations) that is, it is not necessary that the vibrations exceed the 50,000 cycles per second.

The propagation rate is equal to the frequency (f) multiplied by the wave length:

$$U=f+y$$

wherein

U=speed, f=wave frequency, and y=wave length.

Therefore, if 30,000 cycles per second are emmited to a speed of 5,000 meters per second, the result of the wave length will be 16.67 centimeters:

According to above formulae, y=U/f=5,000 m/sec/30,000 cycles/sec=0.167 m/cycles;

y=16.67 cm.

The above shows how easy is to handle this situation once the hull material has been determined.

According to the invention, particularly referring to FIG. 1, an emmiting source E (ultrasonic apparatus) is located in the vessel, preferably at the bow end thereof and between the water surface and the keel. A receptor D for controlling the operation and efficiency of the emmisors is located in the stern, and the information thereof may be received at the operating bridge P. The interconnection between the several devices of the invention may be achieved by any conventional circuitry which is in the scope of any man skilled in the art.

There are many ultrasonic apparatuses in the market, like simple generators that operate by means of a quartz crystal and high frequency alternate current, such as the one illustrated in FIG. 2. This comprises an electric generator G that modulates energy available from a source to supply by an output, an alternate current of, for example 30 kH, to a mechanical transducer Q. The transducer Q comprises in turn a piezoelectric crystal, such as a quartz crystal in which an electric axis is defined according to which the transducer is excited in the pins e+, e− and a mechanical axis that is perpendicular to two faces m+, m− of crystal Q. Face m+ is the active face that is fixed to the hull in order to transmit an elastic vibration to the hull in a predetermined location so as to generate a travelling ultrasonic wave extending along at least one entire submerged surface of the hull. The other face m− of the crystal is fixed to a frame of the vessel like a mechanical reference.

FIG. 3 shows a "magnetostrictive" ultrasonic generator which comprises a magnetostrictive material member M and a magnetic field generator in the form of an electromagnetic coil $B_o$ wound around member M. The generator comprises an oscillator G formed by an amplifier electronic valve V which is fed by a continuous current source I and the plate electrode of which excites the main coil $B_o$ with a sinusoidal current due to the positive feed back through an auxiliar coil $B_r$ which polarizes the grille electrode and by means of which the oscillation amplitude A (FIG. 5) is maintained. An output capacitor $C_o$ is provided to calibrate the oscillation period T according to the optimun frequency of the magnetostrictive member.

In order to maximize the efficiency, a detector transducer D (FIG. 1) may be added to the above cited devices, which may be connected either to a line $L_r$ to negatively feed back the generator G in order to optimize amplitude A impossed like a line $L_q$ to transmit a witness signal to command the indicating devices provided in the operating bridge P so as to give information about failures in the system.

A generator comprising a three layer member formed by steel-quartz-steel, is also provided according to the invention, as it is illustrated in FIG. 4.

In order to prevent the resonating waves from forming nodal points, that is lines or zones wherein the vibrations are neutralized one with the others and the organisms repelling effect is not obtained, because there is no environment alteration, it is preferable to emit two identical waves which should be a quarter wave-length offset. That is the two waves will be out of phase a value y/4 in order to avoid nodal points. In other words, the phases A, either positive or negative, will be offset 25% of the oscillation period y, one respective to the other as it is shown in FIG. 5.

While preferred embodiments of the present invention have been illustrated and described, it will be obvious to those skilled in the art that various changes and modifications may be made therein without departing from the scope of the invention as defined in the appended claims.

I claim:

1. A method for keeping a surface free of scale, fouling and any other kind of dirty generated by the adherence of in water-living organisms such as marine life, the surface being at least part of a body that is in contact with water, the body having a first end and a second end opposite to the first end, a length being defined between the ends, the method comprising the step of generating and emitting, from a submerged location at the first end of the body; at least one high-frequency sound wave train, the train propagating longitudinally along the length of the body, from the first end of the second end of the body, forming, adjacent the body surface, a vibrating field encircling the body surface, without nodal points, wherein the molecular kinetic energy of the water within the field is so increased as to generate a drastic drop in the density of the surface surrounding water as well as in the density of the cells of the organisms entering the vibrating field, thus alterating the habitat of the organisms and discouraging the organisms from adhering to the body surface.

2. The method of claim 1, wherein the wave train is an ultrasonic wave train.

3. The method of claim 2, wherein the ultrasonic wave train is a 30,000 cicles per second elastic wave train.

4. The method of claim 3, wherein said wave train is continuously and steadily generated.

5. The method of claim 4, wherein the at least one wave train comprises two wave trains, which are identical and a quarter-wavelength out of phase.

6. The method of claim 5, further comprising the step of receiving, at a second location of the body, said wave emitted from the first location, and controlling the wave emission.

7. The method of claim 6, wherein the body is a vessel, the first end is the bow of the vessel and the second end is the stern of the vessel, said wave being emitted at the bow and being received at the stern and a control signal is emitted from the stern to actuate on the wave emission and keep a steady wave propagation along the length of the body.

8. Sound wave generating assembly for keeping a surface free of scale, fouling and any other kind of dirty generated by the adherence of in water-living organisms such as marine life, the surface being at least part of a body that is in contact with water, the body having a first end and a second end opposite to the first end, a length being defined between the ends, the assembly comprising at least one wave generating-emitting apparatus for generating and emitting at least one high-frequency sound wave train, the apparatus having an outlet connected to a mechanical transducer affixed to a submerged location in the first end of the body, said wave generating-emitting apparatus being connected to a power source and capable of propagating the train longitudinally along the length of the body, from the first end to the second end of the body.

9. The assembly of claim 8, wherein said detecting device comprises a servo-amplifier connected to a negative feed-back input of the wave generating-emitting apparatus.

10. The assembly of claim 8, wherein the apparatus has a control input and it is connected to a wave detecting device.

11. The assembly of claim 10, wherein the detecting device is mounted in the second end of the body.

12. The assembly of claim 11, wherein the wave generated by the apparatus is an ultrasonic wave.

13. The assembly of claim 12, wherein the ultrasonic wave is a 30,000 cicles per second elastic wave.

14. The assembly of claim 13, wherein said apparatus is capable of continuously and steadily generating and emitting at least one wave train.

15. The assembly of claim 14, wherein the apparatus generates two wave trains which are a quarter-wavelength out of phase.

16. The assembly of claim 11, wherein the body is a vessel, the first end is the bow of the vessel and the second end is the stern of the vessel, the detecting device comprising a receptor located in the stern and capable of emitting a signal to actuate on the wave-generating emitting apparatus to keep a steady wave propagation along the length of the body.

17. The assembly of claim 8, wherein the apparatus comprises an electrical-current ultrasonic-frequency generator having a power input connected to the power source, and said transducer comprises a piezoelectric crystal connected to an output of the electrical current generator.

18. The assembly of claim 8, wherein the apparatus comprises a magnetic-field ultrasonic-frequency generator and said transducer comprises a magnetostrictive member connected to the body and to the magnetic field generator.

19. The assembly of claim 8, wherein the apparatus and the transducer comprise a three-layer device consisting of a steel-quartz-steel arrangement.

* * * * *